United States Patent [19]

Caruso et al.

[11] Patent Number: 4,815,566

[45] Date of Patent: Mar. 28, 1989

[54] DRAIN VALVE AND SYSTEM

[76] Inventors: John W. Caruso; Daniel J. Caruso, both of P.O. Box 70238, San Diego, Calif. 92107

[21] Appl. No.: 121,208

[22] Filed: Nov. 16, 1987

[51] Int. Cl.[4] ..... F01M 11/04

[52] U.S. Cl. ..... 184/1.5; 251/216

[58] Field of Search ..... 184/1.5; 251/216

[56] References Cited

U.S. PATENT DOCUMENTS

| | | | |
|---|---|---|---|
| 3,049,334 | 8/1962 | Montague | 184/1.5 |
| 3,103,947 | 9/1963 | Mueller | 137/351 |
| 3,650,352 | 3/1972 | Schwary | 184/1.5 |
| 3,720,287 | 3/1973 | Martel | 184/1.5 |
| 3,727,638 | 4/1973 | Zaremba et al. | 137/572 |
| 3,867,999 | 3/1975 | Cox | 184/1.5 |
| 3,871,483 | 3/1975 | Espinosa et al. | 184/1.5 |
| 3,874,478 | 4/1975 | Mantell, Jr. | 184/1.5 |
| 4,033,432 | 7/1977 | Berstein | 184/1.5 |
| 4,054,184 | 10/1977 | Marciako | 184/1.5 |
| 4,078,763 | 3/1978 | Yamamoto | 251/96 |
| 4,098,398 | 7/1978 | Meyers | 184/1.5 X |
| 4,101,000 | 7/1978 | Scully | 184/1.5 |
| 4,269,237 | 5/1981 | Berger | 141/346 |
| 4,373,561 | 2/1983 | Berger | 141/330 |
| 4,386,639 | 6/1983 | Gable | 141/351 |
| 4,418,888 | 12/1983 | Jacobson et al. | 251/216 |
| 4,530,421 | 7/1985 | Balch | 184/1.5 |
| 4,533,042 | 8/1985 | Pollacco | 206/223 |

FOREIGN PATENT DOCUMENTS

| | | | |
|---|---|---|---|
| 617438 | 3/1961 | Canada | 251/216 |
| 2212112 | 9/1973 | Fed. Rep. of Germany | 251/216 |
| 1332683 | 6/1963 | France | 251/216 |
| 10128 | 3/1972 | Japan | 184/1.5 |

*Primary Examiner*—Leonard E. Smith

*Attorney, Agent, or Firm*—Charmasson & Holz

[57] ABSTRACT

A drain valve and drain system which includes a gravity drain valve which can be readily installed with common tools, a hose connected to the valve and a drained fluid reservoir. Valve actuation is accomplished by a common tool such as a screwdriver or Allen wrench, in the slotted end of a valve stem which allows a recessed actuator, precluding accidental opening or stem damage. Angled side discharge or valve allows complete gravity drainage and manual installation of valve without simple tools. Side discharge and recessed actuator results in a valve with very compact external dimensions only slightly larger than a drain plug. Appliation of drainage system to crankcase oil drain, results in a clean and reliable method of changing oil without tools, funnels, rags, and pans, without significantly impacting road clearance or full drainage capability.

11 Claims, 1 Drawing Sheet

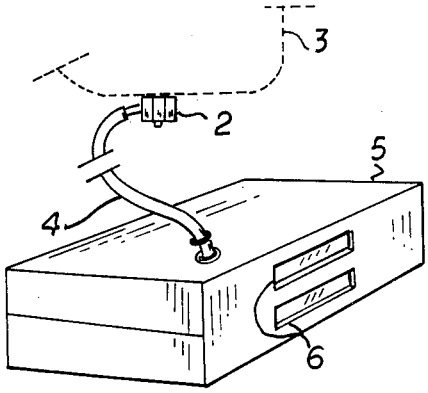
FIG.1
FIG.5
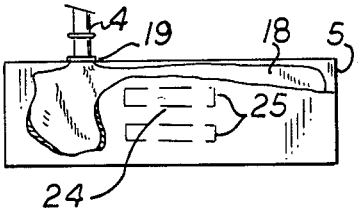
FIG.2
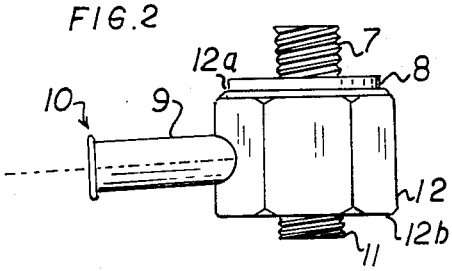
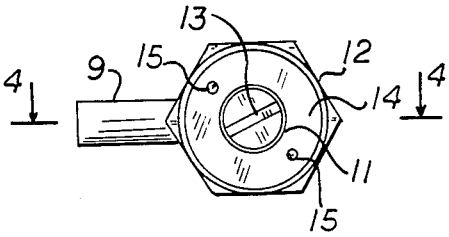
FIG.3
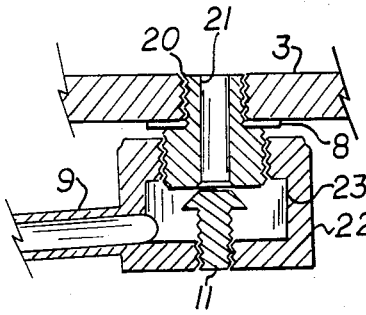
FIG.6
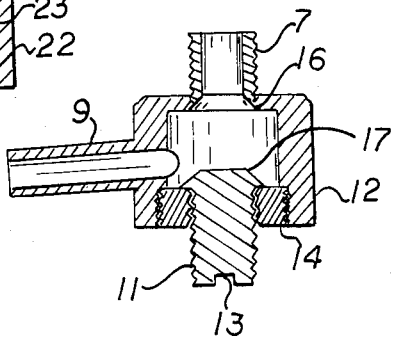
FIG.4

DRAIN VALVE AND SYSTEM

FIELD OF THE INVENTION

This invention relates to drain valves and more specifically to vehicle crankcase drains and drainage systems.

BACKGROUND OF THE INVENTION

This task of changing the oil in internal combustion engines is periodically required to obtain acceptable performance and engine life. Many industrial and aircraft internal engines are equipped with oil crankcase drainage systems to facilitate this required maintenance. However, many internal combustion engine crankcase drain ports, especially automobile and boat engines, come equipped only with plugs. In order to drain oil, a funnel, oil receptacle and wrench are typically used in conjunction with disposable rags to clean the splash that inevitably occurs. In addition, the drained oil must then be typically transferred again for disposal or recycling. Frequent use may also result in stripped threads and leakage at the drainplug.

Because of the nature of this maintenance chore, many consumers have oil changes done at a service station or garage. The need to place automobile, get the proper funnel and tools, obtain and place oil receptacle, remove plug, clean plug, clean funnel, clean oil receptacle, clean tools, transfer oil for disposal/recyling, risk of spills, risk of stripped threads, replacement of tools and under engine position deters many consumers from accomplishing these periodic chores.

Many previous attempts have been made to improve and simplify this task. U.S. Pat. No. 3,727,638 represents one type of simple system. The drain plug is replaced by stem draining valve attached to a hose and receptacle. The valve is closed during engine operation and opened after connecting hose and receptacle. A dust cap was provided to protect the exposed hose fitting and the valve stem during engine operation. Installation and operation of the valve required tools, specifically wrenches acting on stem or tubular valve body.

This type of simple drain system eliminates many problems with the conventional automobile crankcase draining efforts previously described. However, the hose fitting dust cap removal added an operation. The exposed position of valve stem fitting also interfered with ground clearance on vehicle. The stem was susceptible to loosening and damage by road debris. In addition, two tools were now required for operation, one wrench to retain valve body and a second to operate the valve stem. The drained oil receptacle was typically a bag or expended new oil container. Variations on this basic approach include hose fittings which opened valve when attached, (U.S. Pat. No. 4,269,237) sophisticated latched valves (U.S. Pat. Nos. 4,078,763 and 3,874,478) or rupture diaphragms (U.S. Pat. No. 4,373,561). Variations have solved some of the noted problems, but add new problems of cost and added complexity.

A second approach to this draining task is remote control drain valves. U. S. Pat. No. 3,650,352 is typical of this approach which includes a cable, knob, cable and knob support, latch and cable operated valve.

Although this approach allows the drain to be actuated remotely, it still requires the connection and/or placement of a used oil receptacle proximate to the drain port. Cables, supports, seals and valve also adds significantly to cost and complexity, and requires significant space on engine for mounting remote valves, cable supports, and knob/latch supports. Variations include combined drain hose and cable runs (U.S. Pat. No. 3,871,483) or placing valve/plug at the end of a permanently attached drain hose (U.S. Pat. Nos. 4,033,432 and 3,103,947).

Still another approach is to combine a disposable receptacle with the drain valve. U.S. Pat. No. 4,386,639 is an example. This approach typically includes a spring-loaded valve, a disposable receptacle, which includes a fitting which attaches to/and opens valve. Variations include a disk valve and snap fitting (U.S. Pat. No. 4,530,421), and a drain pan/receptacle combination (U.S. Pat. No. 4,054,184). The special fittings required by this approach add significantly to the cost and complexity, since receptacle fitting is disposed of at each oil change. Special fittings on vehicles also generally require protective covers when not in use.

Other approaches have included complex pumping modules to evacuate old oil and dispense new oil (U.S. Pat. No. 3,867,999), drain plug removal mechanisms with drainage systems (U.S. Pat. No. 4,592,448) or with receptacle (U.S. Pat. No. 4,533,042), and disposable receptacles which originally contained new oil and, when empty, receive drained oil (U.S. Pat. No. 4,098,398).

All of these approaches have found limited application. This appears to be a result of excess cost and/or remaining problems. All approaches to date have (1) required tools or permanent attachments to install and/or operate the drainage system, and (2) require significant additional engine space and/or impair road clearance.

Critical to this application is the discharge valve replacing the drain plug. Most prior applications use stem discharge designs, but these all require more space, possibly impacting road clearances. Bottom or through stem discharges are also exposed to road debris.

SUMMARY OF THE INVENTION

The principal and secondary objects of this invention are:

To provide a simple draining system to contain and release fluid from a container;

to allow unskilled consumers to install and operate the fluid draining system without use of formal tools;

to minimize space and impact on clearances;

to minimize exposure of system to damage or loosening;

to eliminate spillage during drain operation; and to encourage recycling of drained fluids.

These and other objects are achieved by a side discharge valve and washer replacing the drain plug in an oil crankcase or other fluid container drain port. The side discharge tube is at an obtuse angle with drain port and pointed away from debris to promote drainage and prevent damage. The tube also allows leverage to install valve body by hand tightening in the threaded drain port. The closed valve protrudes a minimum distance as the actuator stem is recessed in body and may be provided with a slotted head to receive a screwdriver or a socket head to receive an Allen wrench for turning the threaded stem. The discharge tube requires no special fitting for attachment by hand of a disposable plastic hose. The hose is attached to a portable bag or box or bag contained within a box for easy recycling or disposal. The total system can be installed and operated without specialized tools, takes little more space than the drain plug it replaces, protects the valve actuator and discharge tube from accidental damage or loosening, eliminates splash or spillage, has full gravity drainage, and provides a convenient, easy to carry container for drained fluid disposal or recycling.

BRIEF DESCRIPTION OF THE DRAWING

FIG. 1 is an orthogonal view of the drainage system;
FIG. 2 is a side view of drain valve;
FIG. 3 is a bottom view of drain valve;
FIG. 4 is a cross-sectional side view of valve;
FIG. 5 is a sectional view of disposal container; and
FIG. 6 is a side sectional view of alternate valve configuration.

DESCRIPTION OF THE PREFERRED EMBODIMENT

FIG. 1 shows a perspective veiw of the drainage system during draining. Drain valve 2 is attached to crankcase 3 (shown dotted for clarity) at the threaded drain port. The drain valve 2 replaces the drain plug (not shown for clarity) typically found in the drain port. A drain hose or tubing 4 attached to a port at the rear of drain valve 2 and to a fluid receptacle 5. Slots 6 in receptacle 5 create a carrying handle or strap 24.

FIG. 2 is a side view of drain valve 2 in the open position. The drain valve consists essentially of a hex-nut-shaped body 12 which defines an internal shallow cavity 2 to 3 centimeters high between substantially flat and parallel roof 12*a* and bottom 12*b*. External threads on drain inlet port 7 mate with internal threads at drain port of crankcase 3 (FIG. 1). Elastomeric washer 8 is provided for sealing against crankcase 3 (see FIG. 1) and positioning of discharge tube 9. Several washers of various thicknesses can be provided with user selecting the one which permanently positions the discharge tube in a downward or protected position with respect to crankcase 3 (see FIG. 1). A lip 10 can be provided at the edge of the discharge tube to help retain tubing 4 (FIG. 1), but is not necessary. Valve stem 11, which with its disk-shaped head for the inlet part of obstructor, is shown protruding beyond valve body 12 in the open (draining) position but stem 11 can be within the outside dimensions of valve body 12 in the closed position. The discharge tube 9 changes the direction of fluid flow from drain port by less than 90°.

FIG. 3 is a bottom view of drain valve 2. The discharge tube 9 (shown without lip 10 of FIG. 2) can be of sufficient length and strength to allow hand tightening installation of the valve into drain port of crankcase 3 (FIG. 1,). The slot 13 in stem 11 allows actuation (rotation) to be accomplished with a coin or screw driver, or an Allen wrench as appropriate. Alternatively, a protruding T-handle could be provided attached to the stem instead of a indentation or slot in order to operate the valve without a separate tool. Such a protruding T-handle would be appropriate in applications for the valve where ground clearance is not a factor, such as installation in a boat. A retaining ring 14 has an internally threaded hole which mates with external threads of stem 11. Retainer 14 is shown threadably attached to valve body 12; alternatively the retainer may be permanently attached by press or interference fit without threads. Indents or tapped holes 15 facilitate insertion of retainer 14 without protruding outside the valve body 12 envelope.

FIG. 4 is a cross-sectional side view of a drain valve in the partially open position. Threaded inlet 7 is shown without the elastomeric washer 8 in FIG. 2. This is feasible if valve body 12 is elastomeric and threaded inlet 7 is also threadably attached to valve body 12 as shown allowing positioning of discharge tube 9. Chamfer 16 provides a valve seat for disk 17 attached to stem 11. Slot 13 is provided for actuation of stem 11 and disk 17 to seal against seat 16 for closure. Discharge tube 9 can be restrained by hand during actuation if necessary, but choice of materials and high installation force on valve body can assure stem actuation will not dislodge drain valve from drain port. Note also that valve seat ring 17 not only mates with valve seat 16 in the closed position but that when the valve is fully open the underside of the valve seating disk 17 will seal against the upper surface of retaining ring 14, thereby preventing leakage through the threads of retaining ring 14 during the draining operation.

The valve described above may be connected by a drain tube to a collector consisting either of a plastic or mylar bag, or a bag contained within a rigid container. FIG. 5 is a partially sectioned side view of a disposable rigid container embodiment 5. This can be made from semi-rigid materials such as cardboard, making a lightweight, foldable, but sturdy package protecting a plastic or mylar bag 18 inside container 5. The bag contains discharged oil or fluid from crankcase 3 (see FIG. 1) when the bag 18 is empty, it is in a collapsed state. Bag 18 is attached to hose 4 using a plastic fitting 19 which seals hose 4 to bag 18. A carrying handle is formed in one side of the container 5 by knocking out two parallel sections of cardboard 25 which have been partially cut at the factory to create two holes sized to respectively accept the thumb, and two or three other fingers of one hand.

FIG. 6 is a cross-sectional side view of an alternate configuration valve. Crankcase 3 drain is threadably attached to insert 20 and washer 8. Bored hole 21 allows oil to gravity drain. Annular body 22 is threadably attached to insert 20. Internal cavity 23 can be gravity drained to discharge tube fitting 9. Valve stem 11 is threadably attached to annular body 22 and is shown in the nearly closed position where valve stem does not protrude beyond the external dimensions of annular body 22. While the preferred embodiment and some options have been shown and described, changes and modifications may be made therein within the scope of the appended claims without departing from the spirit and scope of this invention.

What is claimed is:

1. In combination with a fluid holder having a threaded draining outlet, a draining assembly which comprises:

a valve housing defining a shallow fluid chamber between a generally flat roof and a generally flat bottom;

an inlet channel in said roof leading into said chamber, said inlet channel being shaped and dimensioned to threadably engage said draining outlet;

a discharge channel on said housing leading out of said chamber, the respective axes of said inlet channel and outlet channel intersecting at an angle greater than 90° and less than 180°;

at least one resilient gasket placed at the interface between said housing and said fluid holder around said inlet channel, said gasket shaped and dimensioned to allow manual rotation of said housing, reorientating said discharge channel by while sealing the interface between said housing and said fluid holder;

a valve seat formed at the intersection of said chamber and said inlet channel;

an obstructor, within said chamber, shaped and dimensioned to mate with said valve seat in order to close said inlet channel;

means for moving said obstructor from outside said chamber, moving said obstructor in one of two directions, said first direction toward said valve seat and said second direction away from said valve seat, said means for moving shaped and dimensioned not to protrude beyond the major external dimensions of said housing when said obstructor is closing said channel;

a detachable means for manually rotating said means for moving, said rotation moving said obstructor in one of said directions, said means for manually rotating not in direct contact with said obstructor; and wherein said means for moving comprises:

said housing having a threaded bore in said bottom, said bore being coaxial with said inlet channel;

a threaded shaft engaged into said bore, said threaded shaft having an inner end shaped and dimensioned to mate with said obstructor and an outer end including means to manually rotate said shaft.

2. The combination claimed in claim 1, wherein said detachable means for manually rotating comprises a coin applied to said outer end .

3. The combination claimed in claim 1, wherein said obstructor forms a head having a frusto-conical shape and a base diameter larger than the cross-sectional diameter of said threaded shaft, said head being shaped and dimensioned to intimately seal said threaded bore when said threaded shaft is unscrewed and contacting said bottom.

4. The combination as claimed in claim 1, wherein said detachable means for manually rotating comprises said outer end having a depression therein shaped and dimensioned to engage a torquing means.

5. The combination claimed in claim 4, wherein said torquing means comprises an Allen wrench.

6. The combination claimed in claim 4, wherein said torquing means comprises a screwdriver.

7. The combination claimed in claim 6, wherein said shallow fluid chamber does not exceed 3 centimeters in height.

8. The combination claimed in claim 4, wherein said assembly further comprises:

a flexible hose attached to said discharge channel; and a drain pouch which is connected to said hose and retains fluid.

9. The combination claimed in claim 8, which also comprises an enlarged lip portion of said discharge channel having a diameter larger than the internal diameter of said flexible hose.

10. The combination claimed in claim 8, wherein said pouch comprises:

a flexible fluid container attached to said hose;

a rigid package containing said fluid container; and a carrying handle associated with said package.

11. The combination claimed in claim 10, wherein said carrying handle comprises two removable strips of said rigid package material shaped and dimensioned to define a pair of oblong parallel holes.

* * * * *